US009261043B2

(12) United States Patent
Teruya

(10) Patent No.: US 9,261,043 B2
(45) Date of Patent: Feb. 16, 2016

(54) STOP CONTROL SYSTEM FOR ENGINE

(71) Applicant: SUZUKI MOTOR CORPORATION, Shizuoka-Ken (JP)

(72) Inventor: Hiroshi Teruya, Shizuoka-Ken (JP)

(73) Assignee: SUZUKI MOTOR CORPORATION, Hamamatsu-shi (JP)

( * ) Notice: Subject to any disclaimer, the term of this patent is extended or adjusted under 35 U.S.C. 154(b) by 381 days.

(21) Appl. No.: 13/847,039

(22) Filed: Mar. 19, 2013

(65) Prior Publication Data

US 2013/0247871 A1 Sep. 26, 2013

(30) Foreign Application Priority Data

Mar. 21, 2012 (JP) ..... 2012-064159

(51) Int. Cl.

| | |
|---|---|
| ***F02D 45/00*** | (2006.01) |
| ***F02N 19/00*** | (2010.01) |
| *F02N 11/08* | (2006.01) |
| *F02D 41/00* | (2006.01) |

(52) U.S. Cl.

CPC ..... *F02D 45/00* (2013.01); *F02N 19/005* (2013.01); *F02D 2041/0095* (2013.01); *F02N 11/0822* (2013.01); *F02N 2019/008* (2013.01)

(58) Field of Classification Search

CPC ..... F02D 45/00; F02D 41/042; F02D 2041/0095; F02N 2019/008; F02N 19/005; F02N 11/0822

See application file for complete search history.

(56) References Cited

U.S. PATENT DOCUMENTS

2007/0233357 A1* 10/2007 Sugai et al. ..... 701/105

FOREIGN PATENT DOCUMENTS

JP 2011021588 A 2/2011

* cited by examiner

*Primary Examiner* — Stephen K Cronin
*Assistant Examiner* — Xiao Mo
(74) *Attorney, Agent, or Firm* — Barnes & Thornburg LLP

(57) ABSTRACT

A stop control system for an engine including a crankshaft is provided with a motor and a control device. The motor is connected to the crankshaft of the engine, and the control device is configured to stop the crankshaft in a compression stroke of the engine by temporarily driving the motor to thereby assist rotation of the crankshaft that is still being forwardly rotated after starting stop control operation of the engine under predetermined engine stop conditions.

8 Claims, 4 Drawing Sheets

STOP CONTROL SYSTEM FOR ENGINE

PRIORITY CLAIM

This patent application claims priority to Japanese Patent Application No. 2012-064159, filed 21 Mar. 2012, the disclosure of which is incorporated herein by reference in its entirety.

BACKGROUND OF THE INVENTION

1. Field of the Invention

The present invention relates to a stop control system for an engine.

2. Related Art

There has been conventionally known idle stop (idling stop) control in which an engine is stopped when predetermined engine stop conditions are satisfied after a vehicle is temporarily stopped at a traffic light or the like, and the engine is restarted in response to a throttle operation to restart the vehicle.

In the idle stop control, it is preferred to arrange a crankshaft at a predetermined crank angle so as to improve startability of the engine in restarting the engine at a time of being stopped.

Thus, a conventional engine start control device executes "rewind control" in which a motor is driven "after stop" of an engine to reversely rotate a crankshaft to a predetermined crank angle as disclosed in, for example, Patent Document 1 (Japanese Patent Laid-Open Publication No. 2011-21588).

It is required for the conventional engine start control device to be provided with a motor, which can reversely rotate the crankshaft so as to execute the "rewind control" in which the crankshaft that has been stopped is reversely rotated.

When a starter motor is used as the motor for reversely rotating the crankshaft, a circuit that reversely rotates the starter motor is additionally required. When the motor for reversely rotating the crankshaft is provided separately from the starter motor, the number of motors itself increases, and the number of parts connecting the motor and the crankshaft also increases.

In the idle stop control, in an occasion where it is not clear in what stroke the engine is stopped, i.e., in a compression stroke, a explosion stroke, an exhaust stroke, and an intake stroke the engine, it also becomes necessary to forwardly rotate the crankshaft in restarting the engine so as to identify the stroke, which takes much time to restart the engine.

Meanwhile, in the idle stop control, in a case when the engine is stopped in different strokes each time, a time to restart the engine irregularly changes even when the stroke can be identified.

SUMMARY OF THE INVENTION

The present invention was conceived in consideration of the circumstances mentioned above and an object thereof is to provide a stop control system for an engine capable of restarting an engine within a short and almost constant period of time by assisting forward rotation of a crankshaft to thereby stop the engine always in a compression stroke.

The above and other objects can be achieved according to the present invention by providing a stop control system for an engine including a crankshaft. The stop control system is provided with a motor and a control device. The motor is connected to the crankshaft of the engine, and the control device is configured to stop the crankshaft in a compression stroke of the engine by temporarily driving the motor to thereby assist rotation of the crankshaft that is still being forwardly rotated after starting stop control operation of the engine under predetermined engine stop conditions.

According to the present invention of the characters mentioned above, the stop control system for an engine can restart the engine within a short and almost constant period of time by assisting the forward rotation of the crankshaft and thereby stopping the engine always in the compression stroke.

The nature and further characteristic features of the present invention will be made clearer from the following descriptions made with reference to the accompanying drawings.

DESCRIPTION OF THE PREFERRED EMBODIMENT

A stop control system for an engine according to an embodiment of the present invention will be described hereunder with reference to the accompanying drawings of FIGS. 1 to 4.

It is further to be noted that, in the present embodiment, the terms: front, rear, upper, lower, right, and left refer to directions based on a user of a motorcycle 1, i.e., a rider who rides on the motorcycle 1.

Figure 1:
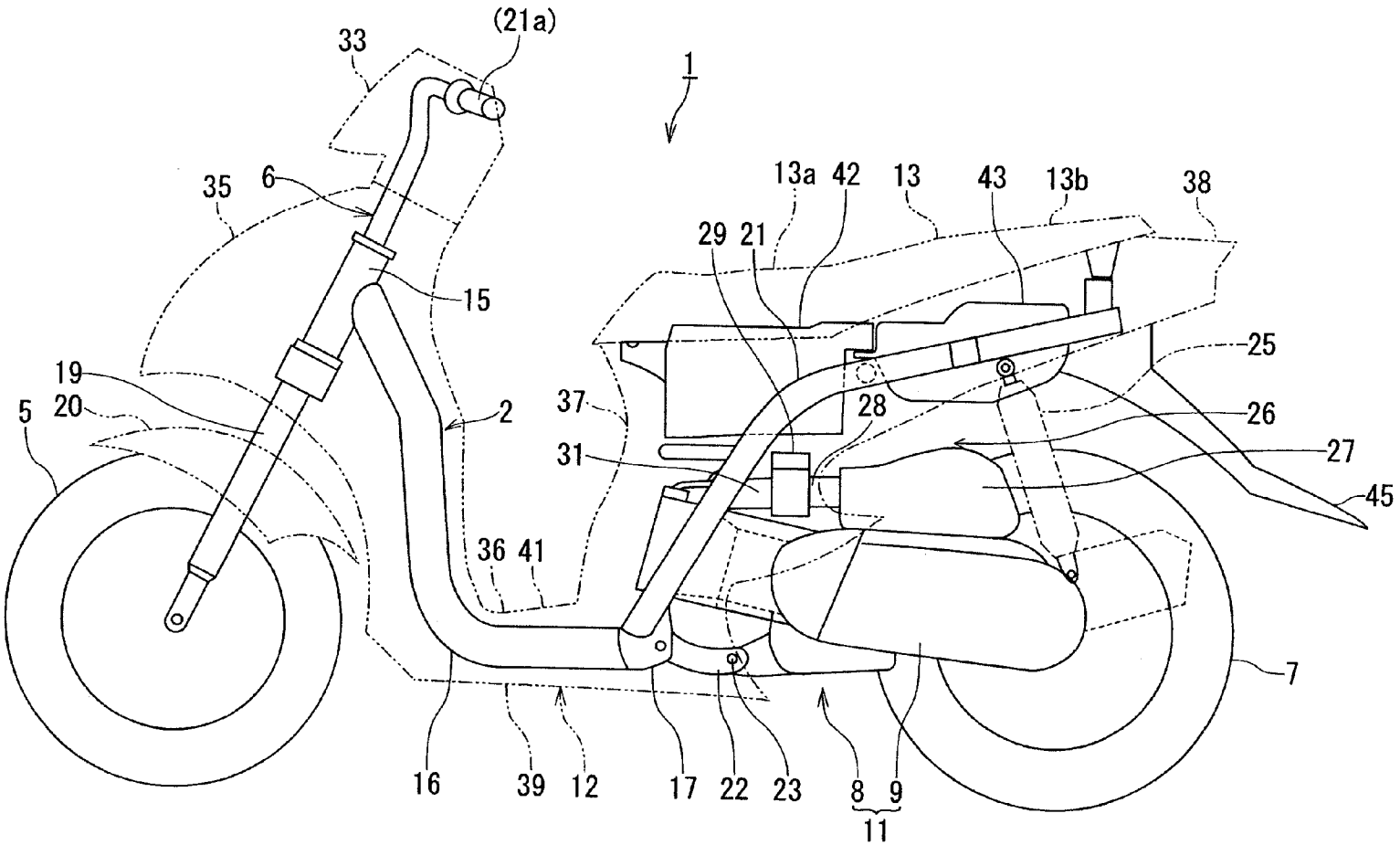
FIG. 1 is a left side view illustrating a motorcycle to which a stop control system for an engine according to an embodiment of the present invention is applied.

As shown in FIG. 1, the motorcycle 1 according to the present embodiment is a scooter-type vehicle. The motorcycle 1 comprises a vehicle body frame 2, a front wheel 5, a steering mechanism 6, a rear wheel 7, a power unit 11, a vehicle body cover 12, and a seat 13.

The vehicle body frame 2 is of so-called under-bone type. The front wheel 5 is arranged ahead of the vehicle body frame 2. The steering mechanism 6 is supported swingably in a right-left direction relative to the vehicle body frame 2 and rotatably supports the front wheel 5. The rear wheel 7 is arranged behind the vehicle body frame 2. The power unit 11 having an integrated unit of an engine 8 and a power train 9 is supported swingably in a vertical direction relative to the vehicle body frame 2, and rotatably supports the rear wheel 7.

The vehicle body cover 12 covers the vehicle body frame 2. A rider sits on the seat 13.

The vehicle body frame 2 includes a plurality of steel hollow pipes that are integrally combined together. More specifically, the vehicle body frame 2 includes a head pipe 15, a down tube 16, an intersection member 17, and a pair of right and left seat rails 18. The head pipe 15 is arranged in a front upper portion of the vehicle. The down tube 16 is connected to the head pipe 15. The intersection member 17 is connected to a rear end portion of the down tube 16. The pair of right and left seat rails 18 are respectively connected to the vicinities of right and left end portions of the intersection member 17.

The head pipe 15 supports the steering mechanism 6 in a steerable manner in the right-left direction (width direction) of the vehicle. The down tube 16 slopes and extends downwardly backward from a front upper end portion connected to the head pipe 15, and is then bent in an L-shape in a side view so as to extend rearward (backward). The intersection member 17 extends in directions to the right and left of the vehicle from a center portion connected to the down tube 16. The right and left seat rails 18 slope and extend upwardly rearward from front lower end portions connected to the intersection member 17. Each of the right and left seat rails 18 includes a front half portion that is inclined at a large angle, and a rear half portion that is inclined at a small angle.

The steering mechanism 6 includes an incorporated suspension mechanism, not shown, a pair of right and left front forks 19, a front fender 20, and a pair of right and left handles 21. The pair of right and left front forks 19 rotatably support the front wheel 5. The front fender 20 covers an upper portion of the front wheel 5. The pair of right and left handles 21 are connected to top portions of the front forks 19.

A rider turns the motorcycle 1 by steering the handles 21 to the right and left. The handle 21 on the right side of the vehicle is an accelerator grip 21*a*.

The power unit 11 also functions as a swing arm. The power unit 11 is coupled to the intersection member 17 via a link member 22. The link member 22 supports the power unit 11 swingably about a pivot shaft 23. A rear cushion unit 25 is suspended between the power unit 11 and the vehicle body frame 2 arranged apart from each other to cushion a force transmitted to the vehicle body frame 2 from the rear wheel 7.

The engine 8 is, for example, a four-cycle internal combustion engine with small displacement in 50 cc or 125 cc class. A center line of a cylinder, not shown, is oriented in a front-rear direction (i.e., longitudinal direction) of the motorcycle 1.

An intake system 26 is arranged above the power unit 11 and supplies a mixture (an air-fuel mixture) to the engine 8. The intake system 26 includes an air cleaner 27, an outlet pipe 28, a fuel injection device 29, and an intake pipe 31 sequentially from an upstream side.

The rear wheel 7 obtains a drive force via the power train 9 from the engine 8.

The vehicle body cover 12 functions as a design surface that covers the vehicle body frame 2 and improves the appearance of the motorcycle 1. The vehicle body cover 12 includes a handle cover 33, a front leg shield 35, a foot board 36, a frame center cover 37, a frame side cover 38, and a frame lower cover 39, which are made of synthetic resin and linked together.

The front leg shield 35 is opposed to the seat 13 on the rear side, and protects a leg portion of a rider by blocking travel wind.

The foot board 36 is a large cover linked to the front leg shield 35, the frame center cover 37, and the frame lower cover 39. The foot board 36 includes a foot rest portion 41 on which a rider sitting on the seat 13 bends his knees and places his feet.

The frame side cover 38 is paired on the right and left sides, and covers each side surface of a lower portion of the seat 13. The frame lower cover 39 covers a lower portion of the foot board 36.

The seat 13 includes a front half portion 13*a* on which a rider sits, bending his knees with his feet on the foot rest portion 41, and a rear half portion 13*b* on which a passenger sits. The seat 13 is also linked to the frame side covers 38 while covering upper portions of a storage box 42 and a fuel tank 43.

A rear fender 45 extends rearward from a lower portion of the fuel tank 43 and covers an upper portion of the rear wheel 7.

Next, a stop control system 51 for the engine 8 will be described in detail.

Figure 2:
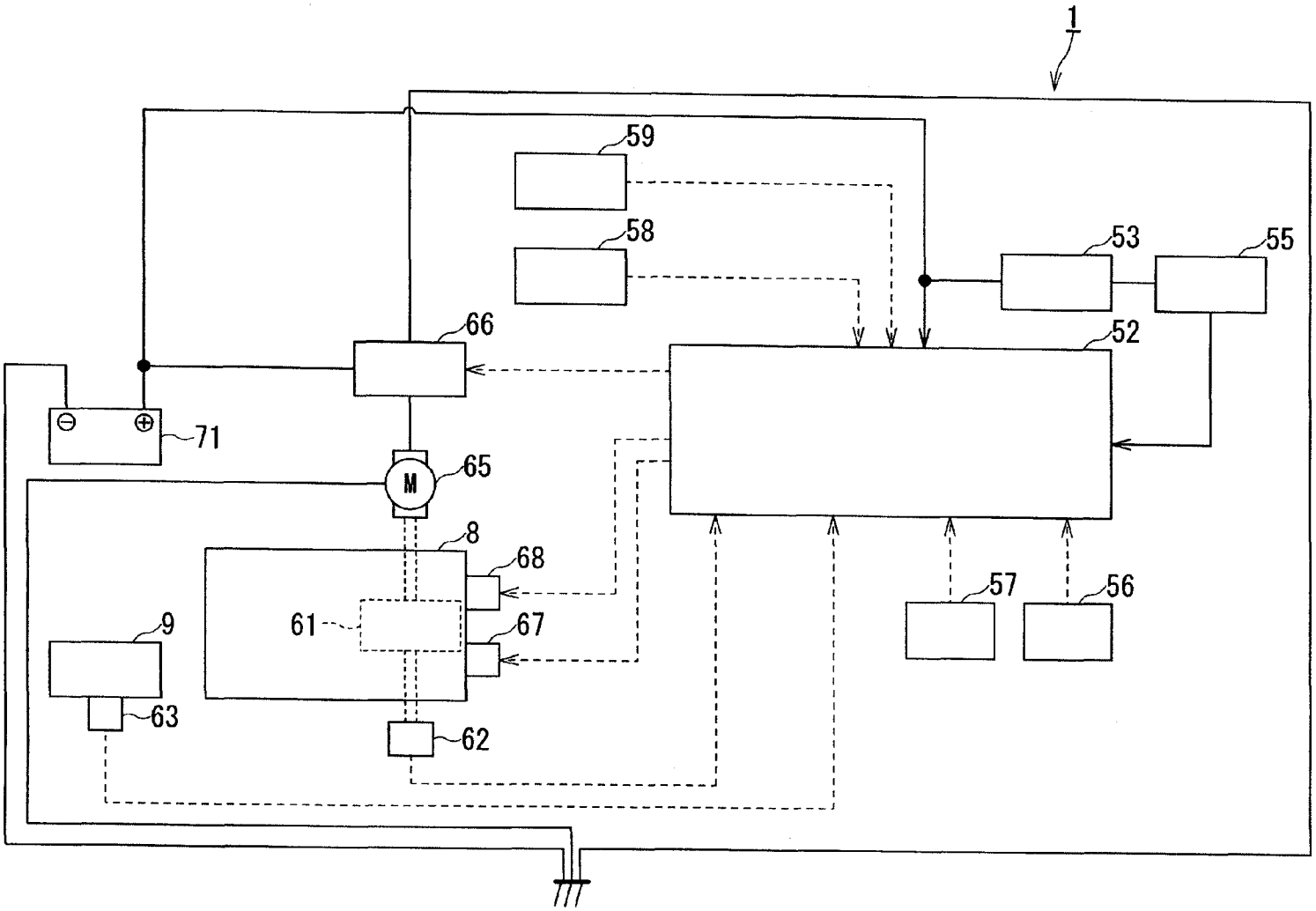
FIG. 2 is a block diagram illustrating the control system of the motorcycle according to the embodiment of the present invention.

FIG. 2 is a block diagram illustrating the control system of the motorcycle according to the embodiment of the present invention.

As shown in FIG. 2, the motorcycle 1 according to the present embodiment comprises a control device 52, and also comprises, around the control device 52, an ignition switch 53, a kill switch 55, a throttle position sensor 56, a water temperature sensor 57, a starter switch 58, and a brake switch 59.

The ignition switch 53 is switched by inserting and removing an ignition key, not shown. The kill switch 55 shuts down the engine 8 by cutting off power supply. The throttle position sensor 56 measures an opening degree of a throttle valve, not shown. The water temperature sensor 57 measures a water temperature of cooling water of the engine 8. The starter switch 58 outputs a starting instruction in response to a starting operation of the engine 8. The brake switch 59 detects whether or not a brake is operated.

The motorcycle 1 also comprises a crank angle sensor 62, a vehicle speed sensor 63, a starter motor 65, a starter motor relay 66, a spark plug 67, a fuel injector 68, and a battery 69.

The crank angle sensor 62 measures a crank angle of a crankshaft 61 of the engine 8. The vehicle speed sensor 63 measures an angular speed of the rear wheel 7 in the power train 9. The starter motor 65 is connected to the crankshaft 61. The starter motor relay 66 supplies power or cuts off the power supply to the starter motor 65. The spark plug 67 ignites the mixture in the engine 8. The fuel injector 68 supplies the mixture to the engine 8.

The control device 52 is a microcomputer and includes a central processor, a memory, and an I/O section, which are not shown. The memory preliminarily stores data such as control programs to be executed by the central processor, and constant numbers necessary for executing the control programs. The memory is also used as a data storage area and a work area that temporarily store operation data or the like of the central processor.

The control device 52 has an idle stop control function to perform idle stop control as one of the control programs.

The control device 52 receives power supply directly from the battery 69, or indirectly from the battery 69 sequentially through the ignition switch 53 and the kill switch 55. The control device 52 also receives signals from the throttle position sensor 56, the water temperature sensor 57, the starter switch 58, the brake switch 59, the crank angle sensor 62, and the vehicle speed sensor 63. The control device 52 further outputs control signals to the starter motor relay 66, the spark plug 67, and the fuel injection device 29 in response to the power supply and the input signals.

The crank angle sensor 62 measures the crank angle by measuring rotation of the crankshaft 61 or a camshaft, not shown, moving in conjunction with the crankshaft 61. The crank angle sensor 62 also detects the engine 8 is in what operation stroke, i.e., of a compression stroke, a explosion stroke, an exhaust stroke, and an intake stroke. The crank angle sensor 62 outputs a measurement result and a detection result to the control device 52. The control device 52 may also identify the stroke of the engine 8 based on the measurement result on the crank angle.

The starter motor relay 66 supplies power or cuts off the power supply to the starter motor 65 by opening or closing an electrical path that electrically connects the starter motor 65 and the battery 69.

The starter motor 65 starts the engine 8 by forwardly rotating the crankshaft 61 now at rest. The starter motor 65 does not need to be able to drive the crankshaft 61 in a reverse rotation direction, and thus does not require an electrical circuit for effecting reverse rotation or a mechanism that mediates mechanical connection between the starter motor 65 and the crankshaft 61.

The stop control system 51 comprises the starter motor 65, the crank angle sensor 62, the starter motor relay 66, and the control device 52. The stop control system 51 controls the crank angle sensor 62, the starter motor 65, and the starter motor relay 66 when the control device 52 performs the idle stop control. The stop control system 51 thereby assists the forward rotation of the crankshaft 61, and stops the engine 8 always in the compression stroke.

A series of control processes performed by the stop control system 51 is called "stop process control". The stop process control may be incorporated in the idle stop control, or may be performed as a separate function operating in conjunction with the idle stop control. The stop process control is incorporated in the control device 52 as a stop process control function.

That is, the stop control system 51 comprises the starter motor 65 that is connected to the crankshaft 61 of the engine 8, the crank angle sensor 62 that measures the crank angle of the crankshaft 61, the starter motor relay 66 that supplies power or cuts off the power supply to the starter motor 65, and the control device 52 that stops the crankshaft 61 in the compression stroke by temporarily driving the starter motor 65 and thereby accelerating or maintaining an angular speed (assisting the rotation) of the crankshaft 61 that is still being forwardly rotated after starting the stop control of the engine 8 under the predetermined engine stop conditions.

Next, the stop process control performed by the stop control system 51 will be described with reference to FIG. 3 which is a conceptual diagram illustrating the stop process control performed by the stop control system according to the present embodiment.

Figure 3:
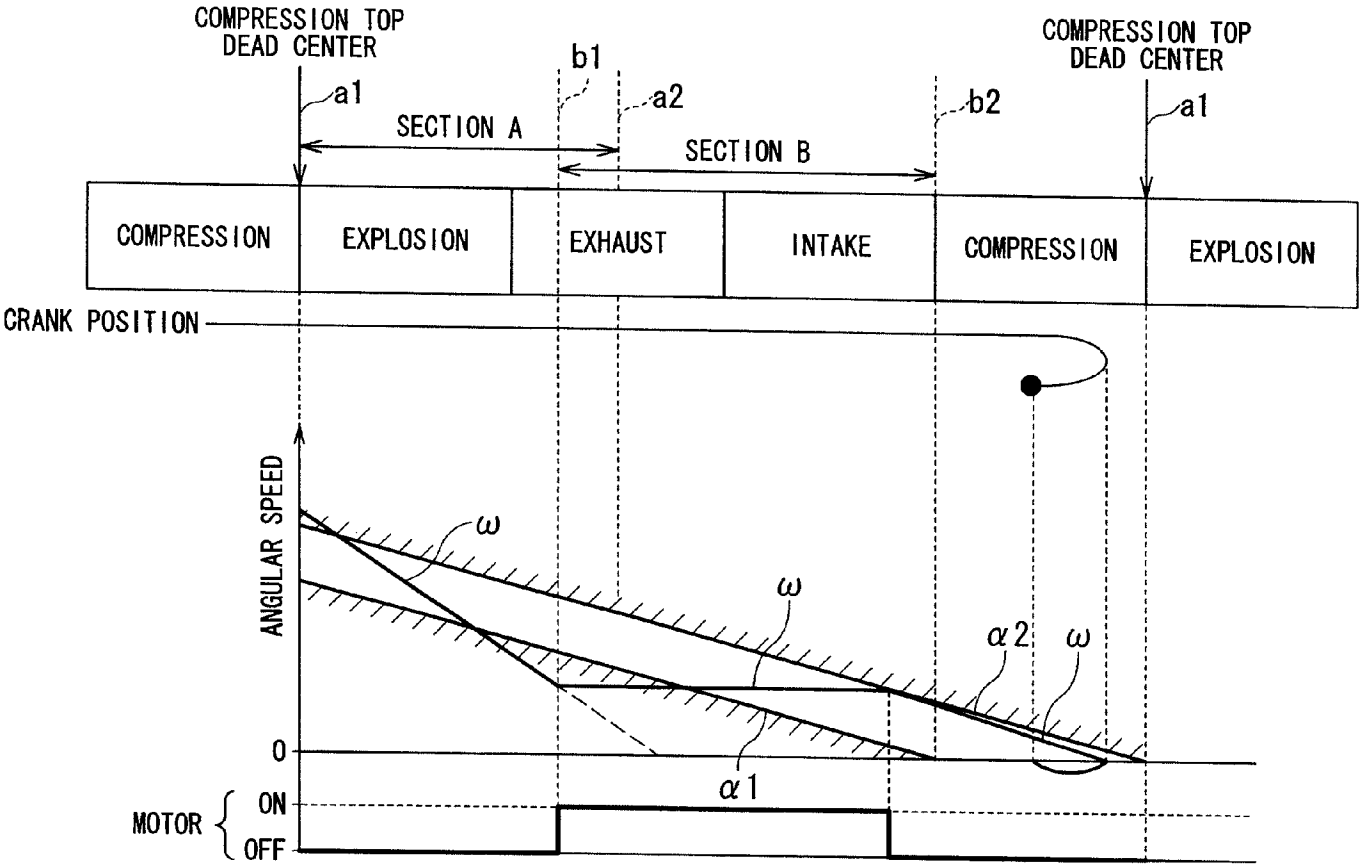
FIG. 3 is a conceptual diagram illustrating stop process control performed by the stop control system according to the embodiment of the present invention.

As shown in FIG. 3, the engine 8 according to the present embodiment is a four-stroke engine in which the crankshaft 61 is rotated twice while a piston, not shown, is moving up and down twice, that is, during one cycle so as to perform a series of operations (one cycle) of sucking the mixture into the cylinder, not shown, compressing the mixture, igniting and exploding the compressed mixture, and discharging combustion gas.

In the stop process control, after the control device 52 starts the idle stop control under predetermined engine stop conditions, an angular speed ω of the crankshaft 61 is monitored during a period from the end of the compression stroke, that is, from a time when the piston reaches a compression top dead center (a1), to the middle of the exhaust stroke, that is, to a time when the crankshaft 61 rotates about 270° (a2) (a section A in FIG. 3). At this time, it is determined whether or not the angular speed ω of the crankshaft 61 is smaller than an angular speed α1 at which the crankshaft 61 can reach the compression stroke.

When it is detected that the angular speed ω of the crankshaft 61 in the section A is smaller than the angular speed α1 at which the crankshaft 61 can reach the compression stroke, the starter motor 65 is temporarily driven during at least one section from the exhaust stroke to the intake stroke, more specifically, during a section from the first half (b1) of the exhaust stroke to the end (b2) of the intake stroke (a section B in FIG. 3). At this time, the starter motor 65 is temporarily driven to assist the rotation of the crankshaft 61 until the angular speed ω of the crankshaft 61 becomes equal to or greater than the angular speed α1 at which the crankshaft 61 can reach the compression stroke and smaller than an angular speed α2 at which the piston moves through the compression top dead center.

Since the angular speed ω of the crankshaft 61 only needs to become equal to or greater than the angular speed α1 at which the crankshaft 61 can reach the compression stroke and smaller than the angular speed α2 at which the piston moves through the compression top dead center during the stroke section B, the rotation of the crankshaft 61 may be assisted by accelerating or maintaining the angular speed ω, or reducing deceleration (reducing negative angular acceleration). The rotation of the crankshaft 61 may be also assisted by temporarily driving the starter motor 65 a plurality of times. The control of the rotation assistance of the crankshaft 61 is based on a change per unit time of the crank angle measured by the crank angle sensor 62.

The crankshaft 61 whose rotation has been assisted as described above reaches the compression stroke, and after reaching the compression stroke, the crankshaft 61 is braked by a compression reaction force applied to the piston. The crankshaft 61 thus starts rotating reversely and stops at any crank angle in the compression stroke.

The stop process control is repeatedly performed per cycle of the engine 8 during the idle stop control.

The stop process control will be described in more detail with reference to the flowchart shown in FIG. 4, which represents the stop process control function performed by the stop control system of the present invention.

Figure 4:
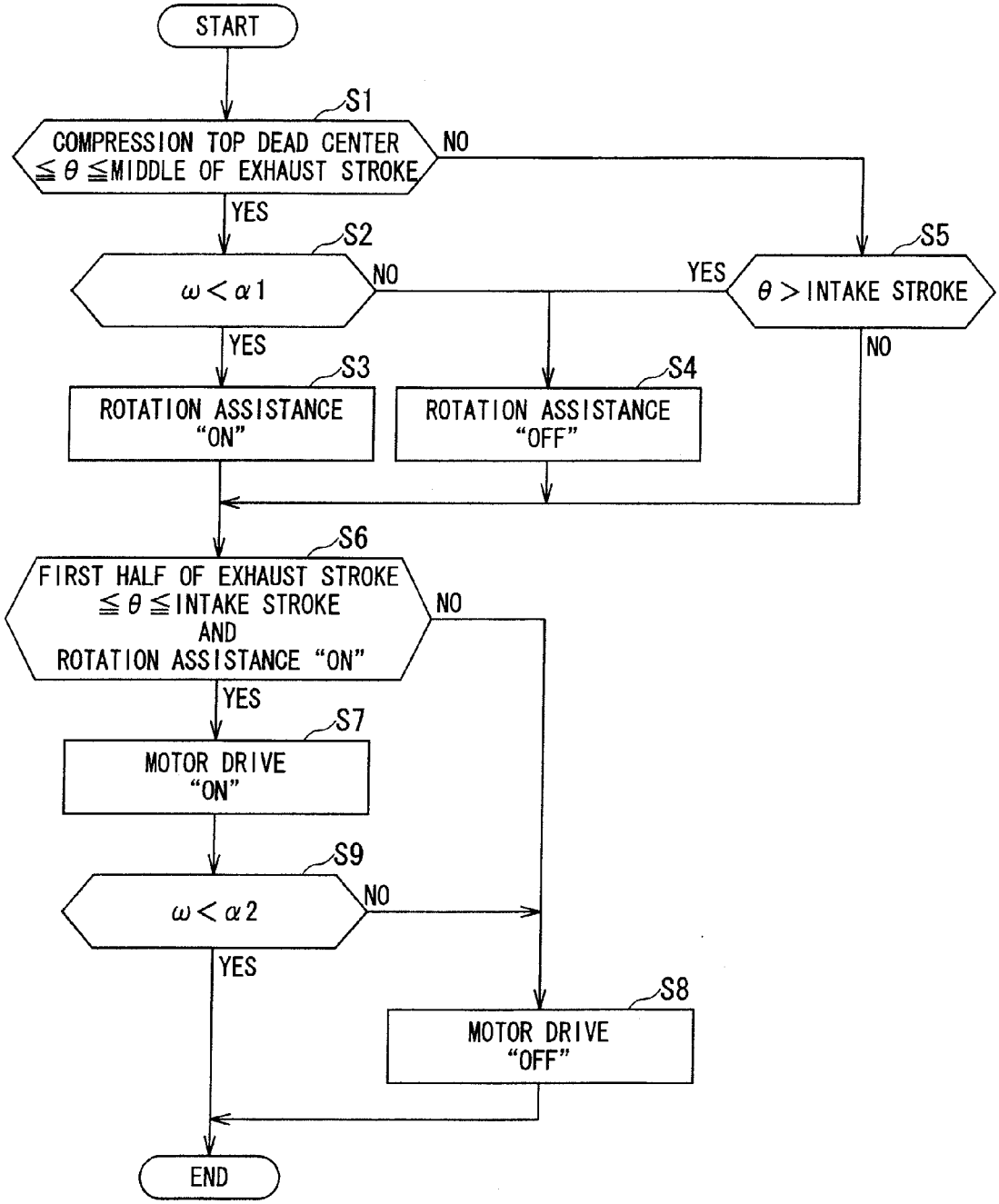
FIG. 4 is a flowchart representing a stop process control function performed by the stop control system according to the embodiment of the present invention.

As shown in FIG. 4, the control device 52 of the stop control system 51 according to the present embodiment monitors the angular speed of the crankshaft 61 during the period from when the piston of the engine 8 reaches the compression top dead center to when the crankshaft 61 rotates about 270°, and determines whether or not the starter motor 65 is to be temporarily driven.

When the angular speed of the crankshaft 61 becomes smaller than the angular speed at which the crankshaft 61 can reach the compression stroke, the control device 52 determines to temporarily drive the starter motor 65.

The control device 52 temporarily drives the starter motor 65 during at least one section from the exhaust stroke to the intake stroke.

The control device 52 temporarily drives the starter motor 65 to assist the rotation of the crankshaft 61 until the angular speed becomes equal to or greater than the angular speed at which the crankshaft 61 can reach the compression stroke and smaller than the angular speed at which the piston moves through the compression top dead center.

The stop process control function by the control device 52 will be more specifically described hereunder.

To simplify the following description, a crank angle when the piston is at the compression top dead center is employed as a reference crank angle=0° (0 degree), a section from 0° to a subsequent bottom dead center (a crank angle of 180°) is employed as the explosion stroke, a section from 180° to a subsequent top dead center (a crank angle of 360°) is employed as the exhaust stroke, a section from 360° to a subsequent bottom dead center (a crank angle of 540°) is employed as the intake stroke, and a section from 540° to a subsequent top dead center (a crank angle of 720°) is employed as the compression stroke.

When the crankshaft 61 is rotated twice to reach a crank angle of 720°, that is, when the piston reaches the compression top dead center again, the crank angle is returned to 0°.

First, the control device 52 starts the idling stop control when predetermined engine stop conditions are satisfied after the motorcycle 1 is temporarily stopped at a traffic light or the like. The stop control system 51 also starts the stop process control.

When the stop process control is started, the control device 52 acquires a present crank angle θ (θ degrees) from the crank angle sensor 62, and determines whether or not the crank angle θ is between 0° and 270° (that is, between the compression top dead center and the middle of the exhaust stroke) in step S1. When the crank angle θ is between 0° and 270°, the control device 52 proceeds to the control of step S2. Otherwise, the control device 52 proceeds to the control of step S5.

In step S2, the control device 52 calculates the present angular speed ω of the crankshaft 61, and determines whether or not the calculated present angular speed ω of the crankshaft 61 is smaller than the angular speed α1 at which the crankshaft 61 can reach the compression stroke. When the present angular speed ω of the crankshaft 61 is smaller than the angular speed α1 at which the crankshaft 61 can reach the compression stroke, the control device 52 proceeds to step S3. Otherwise, the control device 52 proceeds to step S4. To calculate the present angular speed ω of the crankshaft 61, the control device 52 consecutively acquires the measurement results from the crank angle sensor 62.

In step S3, the control device 52 stores information that the rotation of the crankshaft 61 needs to be assisted (rotation assistance ON information), and proceeds to step S6.

In step S4, the control device 52 stores information that the rotation of the crankshaft 61 does not need to be assisted (rotation assistance OFF information), and proceeds to step S6.

Meanwhile, in step S5, the control device 52 acquires the present crank angle θ from the crank angle sensor 62, and determines whether or not the acquired crank angle θ exceeds 540° (that is, whether or not the crankshaft 61 is in the compression stroke through the intake stroke). When the crank angle θ exceeds 540°, the control device 52 proceeds to step S4. Otherwise, the control device 52 proceeds to step S6.

Subsequently, in step S6, the control device 52 determines whether or not the starter motor 65 is to be driven. More specifically, the control device 52 acquires the present crank angle θ from the crank angle sensor 62, and judges whether or not the crank angle θ is between 225° and 540° (that is, from the first half of the exhaust stroke to the intake stroke), and whether or not the rotation assistance ON information is stored. When the crank angle θ is between 225° and 540°, and the rotation assistance ON information is stored, the control device 52 proceeds to step S7. Otherwise, the control device 52 proceeds to step S8.

In step S7, the control device 52 closes the starter motor relay 66 and drives the starter motor 65. The control device 52 then proceeds to step S9.

In step S8, the control device 52 opens the starter motor relay 66 to cut off the power supply to the starter motor 65. The control device 52 thereby terminates the stop process control.

In step S9, the control device 52 calculates the present angular speed ω of the crankshaft 61, and determines whether or not the calculated present angular speed ω of the crankshaft 61 becomes smaller than the angular speed α2 at which the piston moves through the compression top dead center. When the present angular speed ω of the crankshaft 61 becomes smaller than the angular speed α2 at which the piston moves through the compression top dead center, the control device 52 terminates the stop process control. Otherwise, the control device 52 proceeds to step S8.

The stop control system 51 for the engine 8 according to the present embodiment does not perform "rewind control" in which the crankshaft 61 that has been stopped is reversely rotated as in a conventional engine start control device, but can stop the engine 8 in the compression stroke by assisting the rotation of the crankshaft 61 that is still being forwardly rotated by the starter motor 65.

Accordingly, it is not necessary to allow the starter motor 65 to function as a motor for reversely rotating the crankshaft, and the stop control system 51 for the engine 8 does not require a circuit that reversely rotates the starter motor 65. It is also not necessary to provide the motor for reversely rotating the crankshaft separately from the starter motor 65, so that the number of motors itself does not increase and the number of parts connecting the motor for reversely rotating the crankshaft and the crankshaft 61 also does not increase. That is, the stop control system 51 for the engine 8 can stop the engine 8 in the compression stroke by applying the stop process control to the starter motor 65 that starts the engine 8.

Since the stop control system 51 for the engine 8 according to the present embodiment stops the engine 8 in the compression stroke by assisting the rotation of the crankshaft 61 by the starter motor 65, an additional operation of identifying the stroke is not required in restarting the engine in the idle stop control, and a time to restart the engine can be shortened.

Since the stop control system 51 for the engine 8 according to the present embodiment stops the engine 8 always in the compression stroke by assisting the rotation of the crankshaft 61 by the starter motor 65, the time to restart the engine becomes almost constant.

The stop control system 51 for the engine 8 according to the present embodiment determines whether or not the starter motor 65 is to be temporarily driven during the period from the compression top dead center to the time when the crankshaft 61 rotates about 270°. Accordingly, it can be determined, well in advance in an early stage (the explosion stroke, the first half of the exhaust stroke) of one cycle whether or not the rotation assistance of the crankshaft 61 should be performed.

The stop control system 51 for the engine 8 according to the present embodiment determines whether or not the starter motor 65 is to be temporarily driven based on the fact whether or not the angular speed ω of the crankshaft 61 is smaller than the angular speed α1 at which the crankshaft 61 can reach the compression stroke. Thus, the crankshaft 61 can be reliably caused to reach the compression stroke.

The stop control system 51 for the engine 8 according to the present embodiment temporarily drives the starter motor 65 in the section from the exhaust stroke to the intake stroke, that is, assists the rotation of the crankshaft 61 in the stroke section as close as possible to the compression stroke. Accordingly, the crankshaft 61 can be more reliably caused to reach the compression stroke.

The stop control system 51 for the engine 8 according to the present embodiment assists the rotation of the crankshaft 61 until the angular speed ω of the crankshaft 61 becomes equal to or greater than the angular speed α1 at which the crankshaft 61 can reach the compression stroke and smaller than the angular speed α2 at which the piston moves through the compression top dead center. Consequently, the crankshaft 61 can be more reliably caused to reach the compression stroke, and the crankshaft 61 can be prevented from passing through the compression stroke to increase the time to stop the engine.

Since the stop control system 51 for the engine 8 according to the present embodiment can perform the stop process control by the starter motor 65 driven only in one direction, an inexpensive starter motor having no circuit or mechanism for effecting reverse rotation can be employed as the starter motor 65.

As described above, the stop control system 51 for the engine 8 according to the present embodiment can restart the engine 8 within a short and almost constant period of time by assisting the forward rotation of the crankshaft 61 and thereby stopping the engine 8 always in the compression stroke.

It is to be noted that the present invention is not limited to the described embodiment and many other changes and modification or alternations may be made without departing from the scopes of the appended claims.

For example, in the described embodiment, the stop control system 51 may be applied not only to the engine 8 of the scooter-type motorcycle 1, but also to an engine of a super-sport-type motorcycle or an off-road-type motorcycle.

What is claimed is:

1. A stop control system for an engine comprising:

a motor connected to a crankshaft of an engine; and a control device that stops the crankshaft in a compression stroke by temporarily driving the motor to thereby assist rotation of the crankshaft that is still being forwardly rotated after starting stop control of the engine under predetermined engine stop conditions and before stopping rotation of the crankshaft, wherein the control device is configured to monitor an angular speed of the crankshaft and assist the rotation of the crankshaft until the angular speed becomes equal to or greater than the angular speed at which the crankshaft reaches the compression stroke and smaller than an angular speed at which the piston moves through the compression top dead center by temporarily driving the motor at a time when the angular speed of the crankshaft is smaller than an angular speed at which the crankshaft reaches the compression stroke.

2. The stop control system for an engine according to claim 1, wherein the control device is configured to monitor an angular speed of the crankshaft during a period from a time when a piston of the engine reaches a compression top dead center to a time when the crankshaft rotates about 270° and to determine whether or not the motor is to be temporarily driven.

3. The stop control system for an engine according to claim 1, wherein the control device is configured to temporarily drive the motor during at least one section from an exhaust stroke to an intake stroke.

4. The stop control system for an engine according to claim 1, wherein the motor is driven only in one direction.

5. A method of controlling an engine stop, the method comprising:

monitoring an angular speed of an engine crankshaft by a control device; and temporarily driving, by the control device, a motor connected to the engine crankshaft to thereby assist rotation of the crankshaft while the crankshaft is still being forwardly rotated after starting stop control of the engine under predetermined engine stop conditions and before stopping rotation of the crankshaft so as to stop the crankshaft in a compression stroke;

wherein the control device assists the rotation of the crankshaft until the angular speed becomes equal to or greater than the angular speed at which the crankshaft reaches the compression stroke and smaller than an angular speed at which the piston moves through the compression top dead center by temporarily driving the motor at a time when the angular speed of the crankshaft is smaller than an angular speed at which the crankshaft reaches the compression stroke.

6. The method of claim 5, further comprising, determining, by the control device, whether the motor is to be temporarily driven based on monitoring the angular speed of the crankshaft during a period from a time when a piston of the engine reaches the compression top dead center to a time when the crankshaft rotates about 270 °.

7. The method of claim 5, wherein the control device temporarily drives the motor during at least one section from an exhaust stroke to an intake stroke.

8. The method of claim 5, wherein the temporary driving of the motor is performed in only one direction.

* * * * *